US007075438B2

(12) United States Patent
Kent et al.

(10) Patent No.: US 7,075,438 B2
(45) Date of Patent: Jul. 11, 2006

(54) TAGGING SYSTEMS

(75) Inventors: Adrian P. Kent, Cambridge (GB); William J. Munro, Bristol (GB); Timothy P. Spiller, North Somerset (GB); Raymond G. Beausoleil, Redmond, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 146 days.

(21) Appl. No.: 10/903,220

(22) Filed: Jul. 30, 2004

(65) Prior Publication Data

US 2006/0022832 A1 Feb. 2, 2006

(51) Int. Cl.
*G08B 13/14* (2006.01)

(52) U.S. Cl. ..... 340/572.1; 340/686.1; 340/539.13; 235/375; 342/119

(58) Field of Classification Search ..... 340/572.1
See application file for complete search history.

(56) References Cited

U.S. PATENT DOCUMENTS 6,424,665 B1 7/2002 Kwiat et al.
2003/0133714 A1* 7/2003 Gat ..... 398/140

FOREIGN PATENT DOCUMENTS

GB 2383216 A 6/2003
WO PCT-WO 03/096053 A2 11/2003

OTHER PUBLICATIONS

Benson, Oliver et al., "Regulated and Entangled Photons from a Single Quantum Dot" Phys. Rev. Ltrs. vol. 84, No. 11, pp. 2513-2516 (Mar. 13, 2002).
De Dood, Michiel J.A. et al., "Nonlinear Photonic Crystals as a Source of Entangled Photons" Phys. Rev. Ltrs. vol. 93, No. 4, pp. 040504-1-040504-4 (Jul. 23, 2004).
Florentino, Marco et al., "Generation of Ultrabright Tunable Polarization Entanglement Without Spatial, Spectral, or Temporal Constraints", Phys. Rev. A 69 041801-1-4 (2004).

(Continued)

*Primary Examiner*—Jeffery Hofsass
*Assistant Examiner*—Eric Blount

(57) ABSTRACT

A method of verifying the position of a tagging device is described. The method comprises: storing response information in a quantum state of a quantum entity, the quantum entity comprising an entangled pair; separating the entangled pair into first and second entangled particles; conveying the first and second entangled particles to first and second emitters respectively; emitting the first and second particles of the entangled pair respectively from the first and second emitters to the tagging device; recombining the first and second entangled particles in the tagging device to determine the response information; transmitting a signal from the tagging device to at least one of a plurality of detectors; recording the arrival time of the signal at the or each receiving detector, the or each receiving detector being selected on the basis of the determined response information; and comparing the or each receiving detector and the arrival time of the signal at the or each receiving detector with at least one expected receiving detector and an expected arrival time of the signal for the or each expected receiving detector. Matching the expected and actual signal arrival time for an expected detector verifies the position of the tagging device.

13 Claims, 5 Drawing Sheets

OTHER PUBLICATIONS

Kim, Yoon-Ho et al., "Interferometric Bell-State Preparation Using Femtosecond-pulse-pumped Spontaneous Parametric Down-conversion" Phys. Rev. A, 63, 062301-1-11 (2001).
Mandel, L., "Squeezed States and Sub-poissonian Photon Statistics" Phys. Rev. Ltrs., vol. 49, No. 2, pp. 136-138 (Jul. 12, 1982).
Michler, Markus et al., "Interferometric Bell-state Analysis" Phys. Rev. A, vol. 53, No. 3, pp. R1209-R1212 (Mar. 1996).
Scheel, Stefan et al., "Measurement-induced Nonlinearity in Linear Optics" Phys. Rev. A 68, pp. 032310-1-032310-13 (2003).

* cited by examiner

X = Authentication Fail

✓ = No Authentication Fail

TAGGING SYSTEMS

FIELD OF THE INVENTION

The present invention concerns improvements relating to tagging or tracking systems. In particular, though not exclusively, it relates to remote tagging systems that securely authenticate the location of a tagging device.

BACKGROUND OF THE INVENTION

Today's remote tagging (or tracking) systems generally fall into one of two categories. They either comprise a tagging device that is "active" and sends out a signal to a detector, as seen in UK patent application GB2383216 for example, or a tagging device that is "passive" and hence needs to be detected by an active detector signal, as seen for example in International Patent application WO03/096053.

Both types of existing tagging systems have been implemented successfully and, as a result, their use is now relatively widespread. Various objects are tagged so that a remote tracker can either follow their movement or monitor the fact that they are not moving. Tagging systems have, for example, been used in the fields of biology (to track the movements of animals), search and rescue (to find victims in remote areas), and exploration (to enable separated groups to stay in touch). The main area of application for remote tagging systems is however the field of security: the tagging of vehicles, for example, allows car thieves to be apprehended more easily, whilst tagging prisoners enhances the security of prisons or even enables convicts to be monitored at home. Tagging devices (tags) are also used in more sophisticated ways, for instance to help secure boundaries by guaranteeing that the components of boundary security systems cannot be removed unnoticed.

In many of the tagging applications relating to security, and indeed in some applications in other fields, it is essential for the tracker to be able to authenticate the information received from the tag. Users of a tagging system often need to be entirely certain that the information obtained from a tag is correct and has not been tampered with. Similarly, it may be important that the flow of information between a tag and its tracker is not meaningful to an eavesdropper, for instance if the owner of the tagged object wishes to keep his or her identity under wraps. Accordingly, there is a need for secure authentication systems that guarantee the validity and integrity of information received from the tag and ensure that any communications that are intercepted are of no use to eavesdroppers.

A number of existing systems aim to provide secure authentication of a tagging device's position. Most of these systems attempt to mitigate the problem of potential tampering or eavesdropping by securing communications between the tag and the tracker through cryptography. Location information sent out by the tagging device is encrypted using an encrypting algorithm and a secret encryption key, and is eventually decrypted by the tracker with a decrypting algorithm and a decryption key. Unfortunately, although such encryption systems can make it harder for communications between the tag and the tracker to be understood and/or faked by eavesdroppers, there are a number of ways in which their security is flawed.

Firstly, since the encrypting and decrypting algorithms used in classical authentication systems are generally publicly known, secure authentication is rendered impossible as soon as the eavesdropper knows either the encryption key or the decryption key. An eavesdropper equipped with the correct key can decode messages and/or send fake (or spoofed) signals to give the tracker incorrect information concerning the tag, allowing the real position of the tag to be tampered with unnoticed.

Encryption and decryption keys can for instance become known to eavesdroppers if there is momentary access to the tagging device itself (which houses at least the encryption key) or if the entire encryption system is cracked using the information travelling from tag to tracker or tracker to tag. As the processing power of computers increases, it will become easier to crack even relatively sophisticated classical encryption. Any encryption based on classical information thus has a fundamental flaw in that senders and recipients have no way of being entirely sure of whether or not any eavesdropping has taken place. Existing authentication systems can never give users complete peace of mind, since it is in theory possible to crack any classical encryption.

In addition to the problems encountered in the event of a key becoming known it may even be possible to fake the tag's signal without cracking the classical encryption. Depending on the precise working of the classical tracking system, it may be possible to record and play back encrypted information sent to the tracker in the past to give a wrong impression of the tag's current location (a so-called spoof signal).

Furthermore, tracking systems relying on classical encryption possess another disadvantage in that they require the tagging device to have enough processing power to encrypt or decrypt information. This not only increases the size of the tags but also has an effect on the cost of the system. There is inevitably a trade-off between cost/convenience and security, since more advanced encryption algorithms require more processing power and therefore make tags bulkier and more expensive.

The present invention aims to overcome at least some of the problems described above by providing a truly secure method of authenticating the position of a tagging device. The present invention has arisen from the appreciation that whilst authentication systems using classical information can never be considered entirely secure, it is possible to use relativistic signalling constraints and quantum information to achieve extremely high levels of security.

The invention described herein is to a large extent based upon quantum mechanics, quantum information and quantum computation. Some of the fundamentals of these fields can be acquired from "Quantum Computation and Quantum Information" by Michael A. Nielsen and Isaac L. Chuang (henceforth referred to as "Nielsen and Chuang"). In particular, Nielsen and Chuang contains information regarding entanglement and the properties of qubit pairs that are in one of the four Bell states (referred to as Bell pairs in this specification). It also familiarises readers with notations conventionally used in the field of quantum physics and provides ample references to other texts that cover specific areas in greater detail.

SUMMARY OF THE INVENTION

Broadly speaking, the present invention resides in a method of verifying the position of a tagging device, the method comprising: storing response information in a quantum state of a quantum entity, the quantum entity comprising an entangled pair; separating the entangled pair into first and second entangled particles; conveying the first and second entangled particles to first and second emitters respectively; emitting the first and second particles of the entangled pair respectively from the first and second emitters to the tagging device; recombining the first and second entangled particles in the tagging device to determine the response information; transmitting a signal from the tagging device to at least one of a plurality of detectors; recording the arrival time of the signal at the or each receiving detector, the or each receiving detector being selected on the basis of the determined response information; and comparing the or each receiving detector and the arrival time of the signal at the or each receiving detector with at least one expected receiving detector and an expected arrival time of the signal for the or each expected receiving detector; wherein matching the expected and actual signal arrival time for an expected detector verifies the position of the tagging device.

Preferably, the first and second particles cannot be copied when they are in separate locations, so that it is more difficult for an eavesdropper to create a spoofed signal. This is, for example, achieved when the first and second entangled particles form a Bell pair.

It is also a preferred feature that the emitting step comprises emitting the first and second particles such that they arrive at the tagging device at the same time.

Advantageously the method of the present invention may include calculating, at a central management system, the expected signal arrival time for an expected receiving detector, comparing this time with the actual signal arrival time at a receiving detector, and to checking whether detection occurred at the expected detector. When a central management system is involved in this way, the method of the present invention may include alerting a user when the expected signal arrival time for an expected detector does not match the actual signal arrival time.

In one embodiment of the invention, the transmitting step comprises transmitting a quantum signal. This is, for example achieved by redirecting the first and second entangled particles at the tagging device to form the signal sent to at least one receiving detector.

The method of the present invention may also comprise storing at least one of the entangled particles. When this is the case, it is preferred that at least one of the entangled particles is stored before it is emitted.

To further enhance security, the method of the present invention may also comprise arranging the emitters and detectors such that the expected arrival time of the signal at an expected detector can only be consistently matched by actual values if the first and second particles are recombined at the location of the tagging device.

To enable authentication of a tagging device's position over a prolonged period of time, the steps of the method of the present invention may be repeated. Preferably, repetition occurs several times per second.

BRIEF DESCRIPTION OF THE DRAWINGS

In order that this invention may be more readily understood, reference will now be made, by way of example, to FIGS. 1 to 5 of the accompanying drawings in which.

DETAILED DESCRIPTIONS OF THE PRESENTLY PREFERRED EMBODIMENTS

Figure 1:
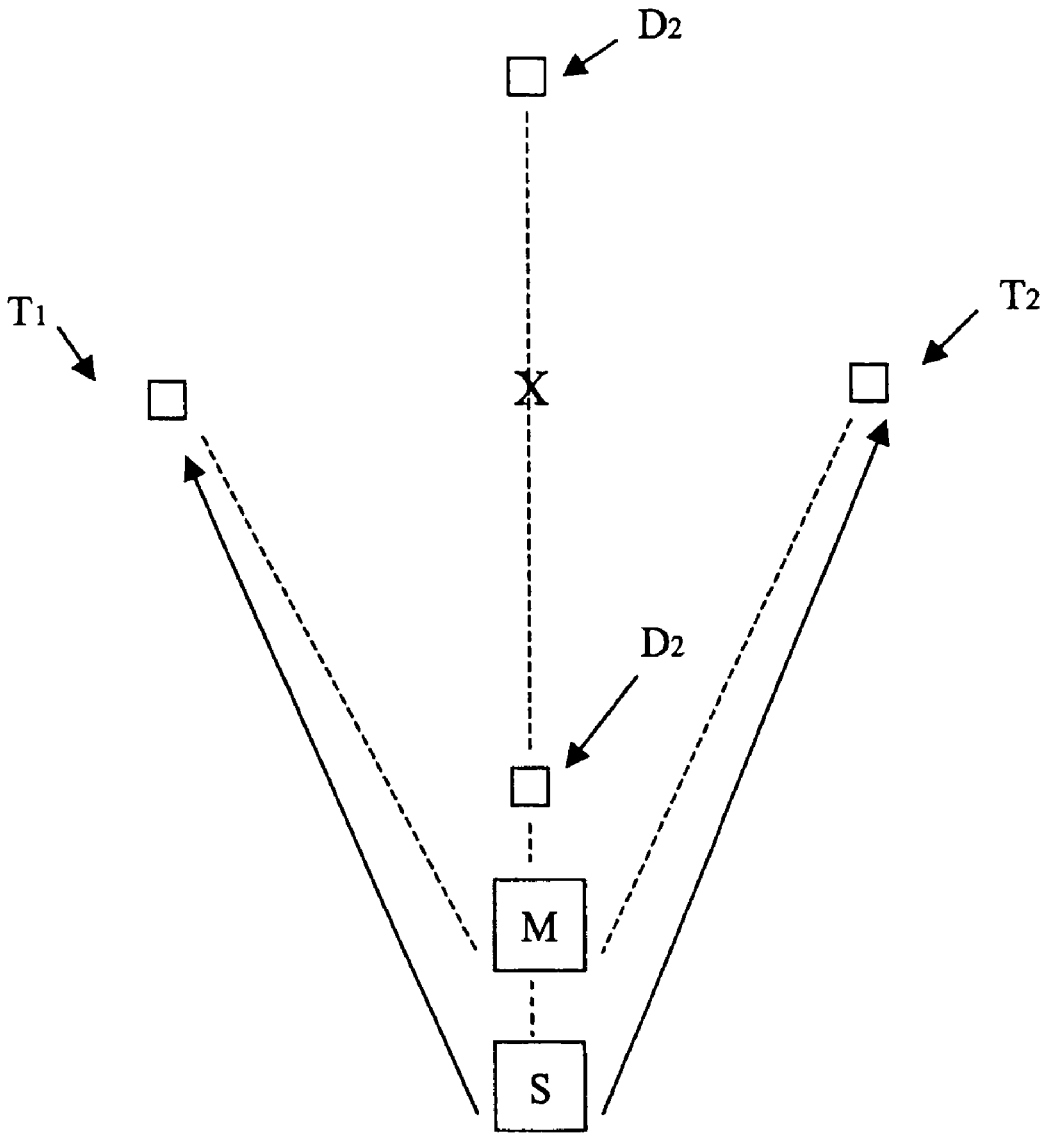
FIG. 1 shows a schematic view of a system for authenticating the position of a tagging device according to a first embodiment of the invention.

Referring firstly to FIG. 1, there is shown a system for authenticating the position of a tagging device, according to a first embodiment of the invention. The system comprises a device, S, for producing Bell pairs, which is connected to first and second equidistant transmitting devices, $T_1$ and $T_2$, via secure connections. First and second detector devices, $D_1$ and $D_2$, are arranged so that the direct path between them, $D_1$–$D_2$, intersects orthogonally with the direct path between the transmitter devices, $T_1$–$T_2$, and the detector and transmitter devices define the four corners of a diamond configuration (or square configuration).

The above components of the system are connected, via secure links to a central management module, M, which in this embodiment is located near the Bell pair source, S, for convenience. A tagging device, X, comprising a quantum gate, Q, is located on the intersection of the paths $D_1$–$D_2$ and $T_1$–$T_2$.

The components shown in FIG. 1 combine to allow the system of the embodiment to determine whether the tagging device, X, remains in its original position on the intersection of the paths $D_1$–$D_2$ and $T_1$–$T_2$. Positional verification by means of this embodiment is extremely secure and, barring a change in the presently accepted laws of Physics, the tagging device X cannot be removed unnoticed unless it is instantaneously replaced by a second identical tagging device.

In essence, the working of the embodiment shown in FIG. 1 relies on three physical principles: the impossibility of signalling faster than light, the so-called "no cloning theory" of quantum physics and the fact that the information in a Bell pair cannot be read when its two particles are separated. To illustrate how these principles are exploited, the working of the system shown in FIG. 1 will now be described. Then, once it is clear why the system is able to perform its task, details of its individual components will be given.

Referring to FIG. 1, first and second photons, together forming a Bell pair, are produced at S, separated, conveyed to transmitters $T_1$ and $T_2$ respectively and then simultaneously transmitted from $T_1$ and $T_2$ respectively to X. At X the first and second photons are then redirected to detectors $D_1$ and/or $D_2$, depending on predetermined information they carry.

The predetermined information carried by the photons is in the form of a Bell state, which can only be read (or copied) effectively if both photons are in the same location. The Bell state of the photons determines exactly how they are redirected and thus dictates a distinct detection pattern at detectors $D_1$ and/or $D_2$. Furthermore, because the distances the photons travel are equal and they both take the shortest possible route for their journeys, they both arrive at X and the appropriate detector(s) after a set, minimum time interval (equal to the time taken for light to travel the distance $T_1$–X–$D_2$).

The time that elapses between transmission of the photons from $T_1$ and $T_2$ and detection at $D_1$ and/or $D_2$ is recorded and analysed by the system; a record of where exactly detection occurs is also kept. If detection of the photons at $D_1$ and/or $D_2$ occurs after a time interval that is longer than the set minimum time interval, or the detection pattern is not as expected, the security of the tagging system may have been compromised and the system's user may be alerted. By contrast, if the actual detection interval and detection pattern matches the expected detection interval and detection pattern, the system guarantees, with an extremely high level of security, that X was in its original position during the transmission of the photons.

It should be noted that if only one Bell pair is transmitted an eavesdropper may guess the detection pattern and thus spoof authentication. However, the position of X can of course be authenticated again and again by the transmission of further Bell pairs. In practice this embodiment of the invention envisages several transmissions per second to provide effective authentication over a prolonged time span. If a high frequency of transmissions is maintained, an eavesdropper cannot consistently fake the correct detection patterns and detection intervals, unless X is instantaneously replaced by an equivalent device at the same position: the first and second particles cannot be copied individually (according to the "no cloning theory" of quantum physics) and the eavesdropper does not know at which detectors the system is expecting an input without reading both particles at the same location. The only location where both particles can be read without potentially compromising the detection interval (limited by relativistic signalling constraints) is the original location of X.

It should also be noted that individual particles contain no meaningful information and that this addresses the problem of privacy of information which is mentioned above.

The process of authenticating the position of X according to the first embodiment of the invention shown in FIG. 1 will now be described in greater detail.

In use, the Bell pair source, S, is configured to produce qubit pairs that are in the following Bell state:

$$\Psi^{+} = \frac{(|01\rangle + |10\rangle)}{\sqrt{2}}$$

Figure 2:
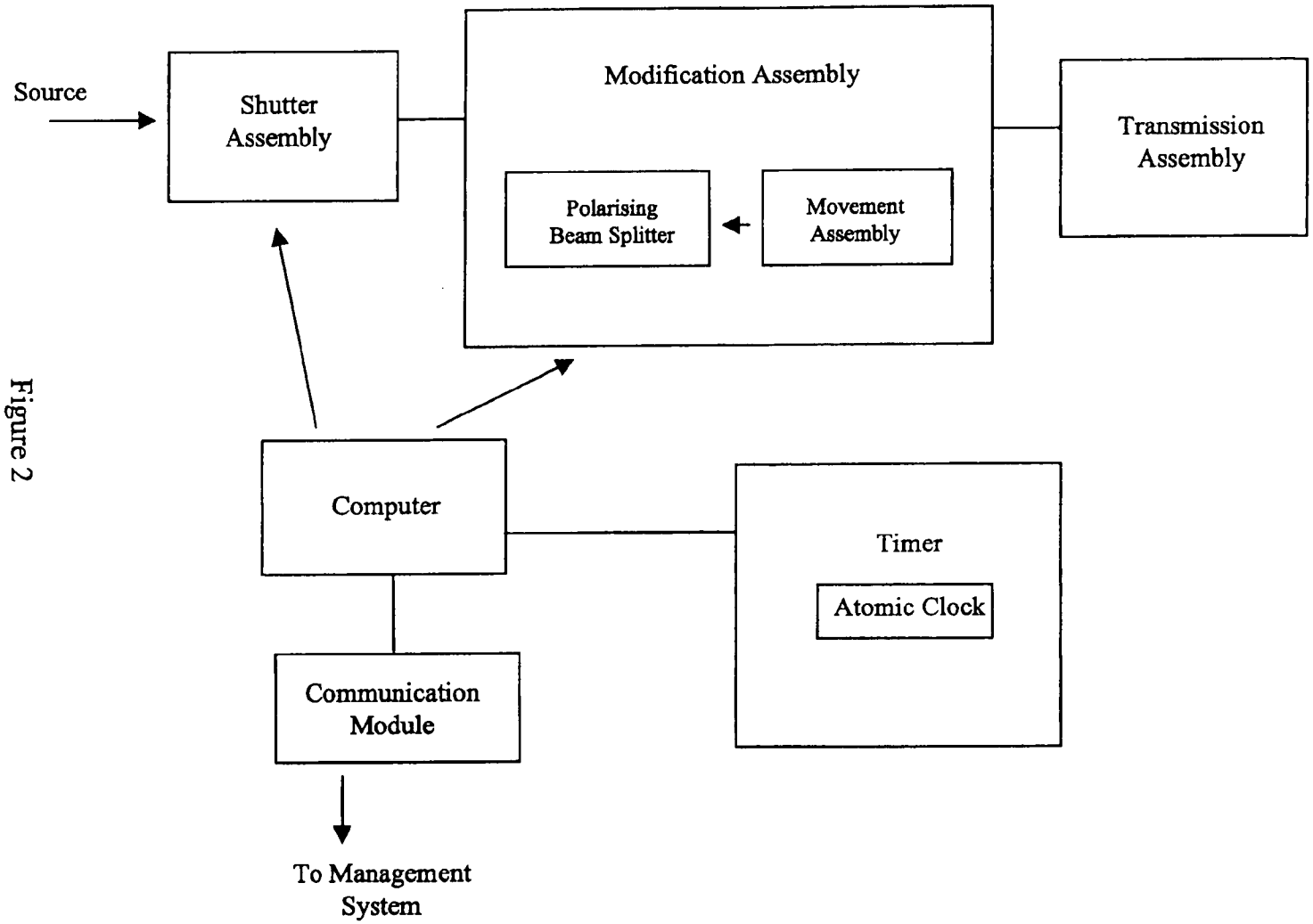
FIG. 2 shows a schematic view of a transmitter as used in the system of FIG. 1.

Theoretically speaking, a Bell pair source is a Hadarmard gate followed by a quantum, CNOT gate, as shown in FIG. 2. The above Bell state can be obtained by feeding such a system with an input of |01>:

$$|0\rangle_C|0\rangle_T \xrightarrow{H} \frac{\{|0\rangle_C|1\rangle_C\}|0\rangle_T}{\sqrt{2}} \xrightarrow{CNOT} \frac{(|0\rangle_C|0\rangle_T + |1\rangle_C|0\rangle_T)}{\sqrt{2}}$$

Commonly known background information concerning Hadarmard and quantum CNOT gates can be found in Nielsen and Chuang.

In practice, qubit pairs in the above Bell state are created by S by passing photons through a parametric down converter. Parametric down conversion is a standard method of creating Bell pairs and two examples of its implementation are described in U.S. Pat. No. 6,424,665 and "*Inferometric Bell state preparation using femtosecond pulse pumped spontaneous down-conversion*" by M. H. Rubin, Y.-H. Kim, Y. Shih, M. V. Chekhova and S. P. Kulik, PRA63, 051201 (2003). Parametric down-conversion produces entangled photons by sending a strong pump laser through a non-linear crystal in which the interaction between the laser and crystal results in entanglement. By manipulating certain parameters such as, for example, the properties of the laser beam and/or the properties of crystal, it is possible to produce photons that are in a specific entangled state, for example the above Bell state.

By recording the specific set-up of the parametric down converter and the exact times at which the laser is switched on, the system knows when exactly each photon pair in the state Bell state $\Psi^{+}$ is produced. This information is sent to the central management module M, where it is recorded.

As an aside, there are numerous methods of creating Bell pairs which are suitable for use in this embodiment of the invention. An example of a method other than parametric down conversion is the quantum dot technique described in "*Regulated and Entangled Photons from a Single Quantum Dot*" by O Benson, C Santori, M Pelton and Y Yamamoto, Phys Rev Lett 84, 2513 (2000). However, for the sake of simplicity, this description will henceforth assume that parametric down-conversion is used to produce the Bell pairs.

It should be noted that parametric down-conversion (like most other sources of Bell pairs) is currently not capable of producing a continuous supply of perfect Bell pairs. Accordingly, depending on the quality of the Bell pair source, it is often necessary to measure some of the entangled photons that are produced in order to obtain an indication of how efficient the down-conversion is. Furthermore, the photons may need to be subjected to entanglement purification or distillation (i.e. some form of error correction) to ensure that only perfect Bell states remain in use. Entanglement purification and distillation are well known in the field of quantum information; details and references can be found in Nielsen and Chuang.

Turning again to FIG. 1, once a steady supply of photon pairs in the desired Bell state is produced at S (if necessary, using distillation or other forms of error correction, not shown), the first and second photons of each Bell pair are separated from each other and sent, via secure optical fibre links, to transmitters, $T_1$ and $T_2$ respectively. Conveniently parametric down conversion has the effect of imparting differing frequencies and spatial modes to the first and second photons of a Bell pair: the photons making up each entangled pair are automatically separated from each other at source, giving rise to first and second beams. Each Bell pair created by the source thus comprises a first photon of the pair in the first beam and a second photon of the pair in the second beam. To complete the separation of entangled photons, mirrors, prisms (not shown) and the secure optical fibre links are used to direct the first and second photon beams to transmitters $T_1$ and $T_2$ respectively.

Referring now to FIG. 2, the transmitters $T_1$ and $T_2$ of this embodiment use a system of mirrors and prisms (not shown) to direct photons between their main internal components, which are a shutter assembly, a modification assembly and a transmission assembly. Both transmitters have the same basic structure and are capable of performing the same operations on the photons that enter them.

When they reach a transmitter, photons arriving from S are firstly directed into the shutter assembly which comprises a computer-controlled pin-hole shutter linked to a timer. The shutter assemblies in transmitters $T_1$ and $T_2$ are connected to (and controlled by) the central management module via secure links and essentially combine to perform the function of reducing the large volume of separated Bell pairs produced by parametric down conversion, say about $10^6 s^{-1}$, to a sparser transmission of periodic single separated Bell pairs.

In the first embodiment of the invention, the shutters' ability to reduce the number of Bell pairs that proceed through the system is reliant on the equidistance of $T_1$ and $T_2$ from S. The first and second photons of a Bell pair travel the same distance at the speed of light before reaching their respective shutters and therefore arrive at their respective shutters at the same time. The shutters within $T_1$ and $T_2$ are periodically opened simultaneously for very brief intervals to allow one photon to pass at each shutter, but block the vast majority of Bell pairs (when in the closed position). Photons that were created by S at precisely the same time inevitably form a Bell pair together and thus the single photons that are allowed to pass the shutters in $T_1$ and $T_2$ respectively at the same time form a Bell pair together. Generally speaking, to ensure that only a single Bell pair is allowed to pass per co-ordinated shutter opening, very short shutter opening times are necessary.

In practice, the precise opening times and opening frequency of both shutters depend on the number of Bell pairs the source produces per second and the number of authentications per second the user of the system desires. Atomic clocks are installed in the transmitters to enable perfect co-ordination of shutter openings at any given frequency. The shutter's opening and closing times, as recorded by a local timer with the help of the atomic clock, are sent by a communication module and via secure connections to the central management module where they are stored. The central management module thus has a record of when exactly the separated photons of a Bell pair are allowed to pass through the shutter assembly of $T_1$ and $T_2$ respectively.

The photons that are allowed to pass through the shutter assembly of a transmitter are directed to the same transmitter's modification assembly. The modification assembly provides an opportunity for the system to alter the Bell state of the photons before they are directed to the transmission assembly. In this embodiment, the modification assembly has the ability to convert the Bell state of a photon from $$\Psi^+ = \frac{(|01\rangle + |10\rangle)}{\sqrt{2}}$$

to $$\Psi^- = \frac{(|01\rangle - |10\rangle)}{\sqrt{2}}$$

whenever it is instructed to do so by the central management module. In practice, this is achieved by a computerised means that moves a polarising beam splitter into the path of the photons whenever a change of Bell state is required.

Whether a given Bell pair is to remain unaltered, i.e. in the state $\Psi^+$, or is to be converted to the state $\Psi^-$ is determined by a randomiser in the central management module. Since the central management module has a record of when a particular Bell pair is allowed to (or is to be allowed to) pass through the shutter assemblies, it calculates from the distance between the shutter assembly and the modification assembly when exactly the polarising beam splitter must be deployed or removed to obtain the result determined by the randomiser. All information concerning modification of the Bell pairs that pass through the shutter assembly is stored within the central management module.

After the photons exit the modification assembly, they are directed to the transmission assembly, which serves to direct the photons, via the atmosphere, onto a lens acting as a receiving means on the tagging device.

The paths the photons take, via the atmosphere, from the transmitters to Q are of the same length and, given transmission coincidence, the photons therefore arrive at the quantum gate at precisely the same time. This coincidence of arrival allows the Bell pair to be instantly recombined and measured within the quantum gate Q.

Figure 3:
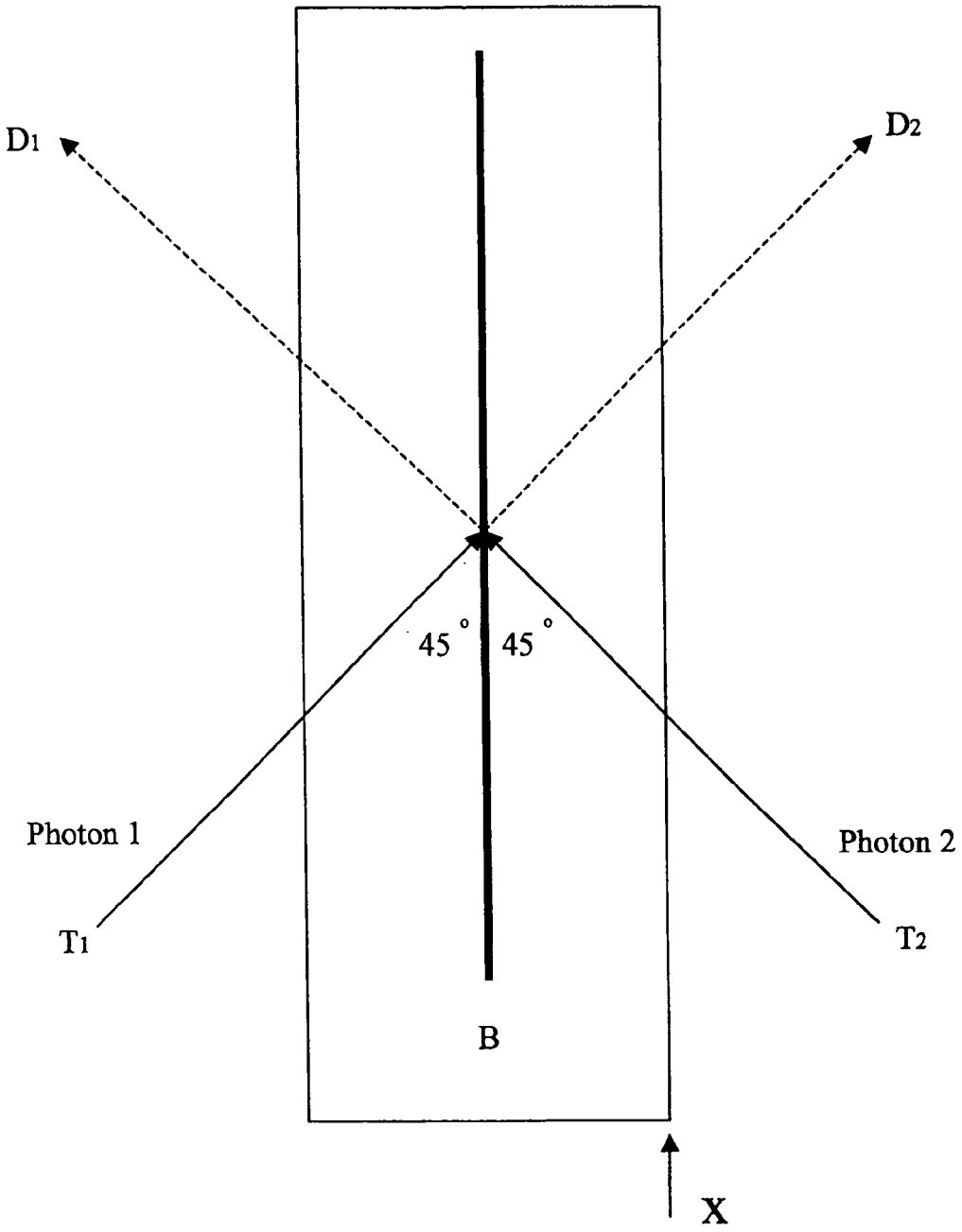
FIG. 3 illustrates the working of the quantum gate within the tagging device of the system of FIG. 1.

FIG. 3 shows that, in the first embodiment, the quantum gate, Q, is a 50-50 beam-splitter. 50-50 beam-splitters have the property of reflecting one half of the light that strikes them whilst allowing the other half to travel through them, and their use as quantum gates is well documented. In particular, a number of works describe how interference effects between photons at 50-50 beam splitters can be used to differentiate between the four Bell states (See "*Inferometric Bell State Analysis*" by Michler, Mattle, Weinfurter and Zeilinger Phys Rev A.53.1209 (1996) and "*Measurement-induced Nonlinearity in linear optics*" by Scheel, Nemoto, Munro and Kinght, Phys Rev A.68.032310 (2003)).

Figure 4:
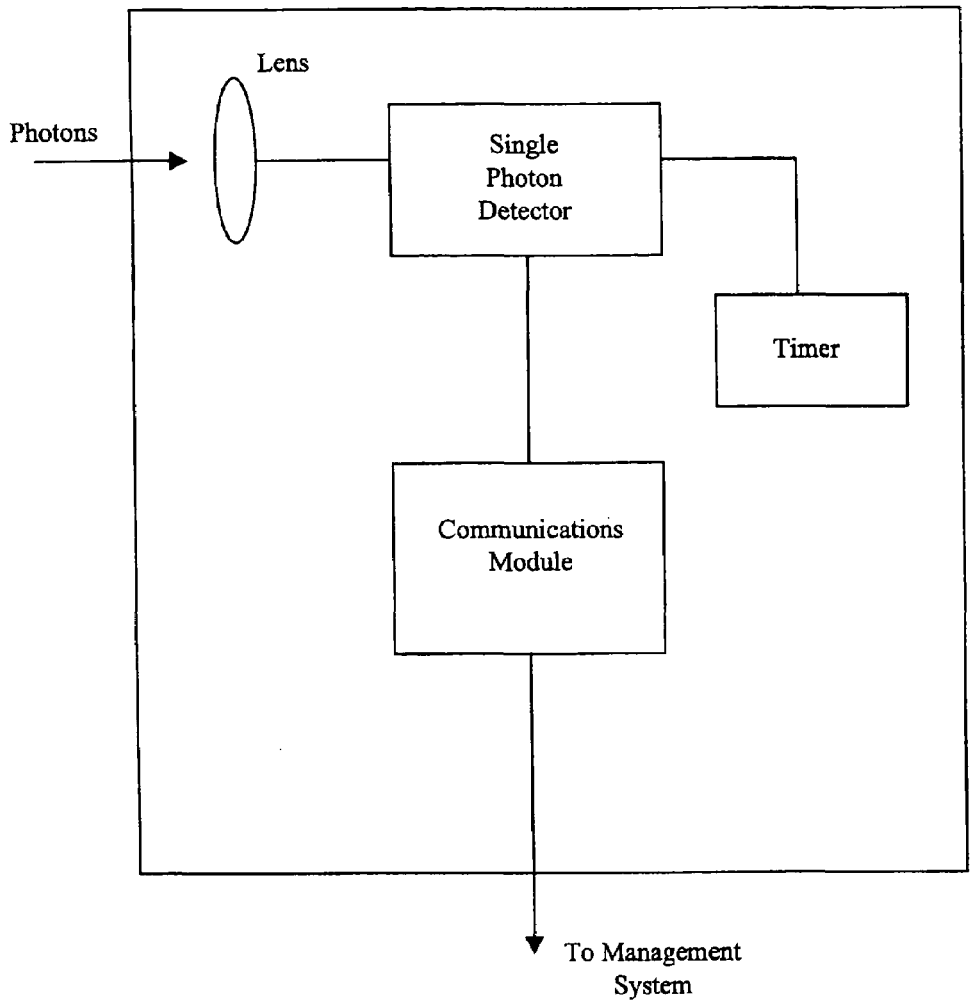
FIG. 4 shows a schematic view of a detector as used in the system of FIG. 1.

In the first embodiment of the invention, the quantum gate merely distinguishes between the states $\Psi^+$ and $\Psi^-$. A relatively simple construction is used to this end. The first and second photons, arriving at the same time from transmitters $T_1$ and $T_2$ are directed (via mirrors and/or lenses if necessary) onto a single point on a single beam splitter, B, from opposite sides of the beam-splitter's surface, such that the photons are both incident at 45 degrees and the input paths are orthogonal to each other. FIG. 4 illustrates how this configuration ensures that only two output directions for photons are possible: reflected photon 1 travels in precisely the same direction as unreflected photon 2 whereas unreflected photon 1 travels in precisely the same direction as reflected photon 2.

Since both photons arrive at the same point at the same time, they overlap at the beam-splitter. As is explained in greater detail in the references cited above, this causes interference effects that determine through which of the two possible output arms the photons escape. In summary, if the two photons of a Bell pair are in the Bell state $\Psi^-$, they will leave the beam-splitter being directed into different output arms, whereas for the Bell state $\Psi^+$, both photons will exit together through one of the two output arms.

The first and second output arms shown in FIG. 3 lead to detector devices $D_1$ and $D_2$ respectively. Given the way the detectors are positioned in this embodiment, mirrors are used to redirect the photons appropriately, taking care that the paths Q-$D_1$ and Q-$D_2$ remain of equal length. Thus state $\Psi^-$ leads to a transmission of one photon to each $D_1$ and $D_2$ whilst state $\Psi^+$ leads to a transmission to two photons to either $D_1$ or $D_2$.

Detectors $D_1$ or $D_2$ have the same basic structure, shown in FIG. 4. They each comprise a lens for receiving photons and a conventional single photon detector arrangement linked to a timer. Single photon detection is well know in the field of optics and information about them can be found in *Progress in Optics II*, L Mondel (1963) and L Mondel Phys. Rev. Lett 49, 136 (1982).

When a photon arrives at a detector, it enters via the lens and is detected by the single photon detector. The timer linked to the single photon detector arrangement then records the precise time of detection and sends this information, via a communication module and secure fibre links, to the central management module.

The central management module comprises computerised means for storing and processing information. Its role is to calculate, for each Bell pair transmission, whether or not a breach of security could have occurred. A flow chart of the calculation performed for each Bell pair is shown in FIG. 5.

Figure 5:
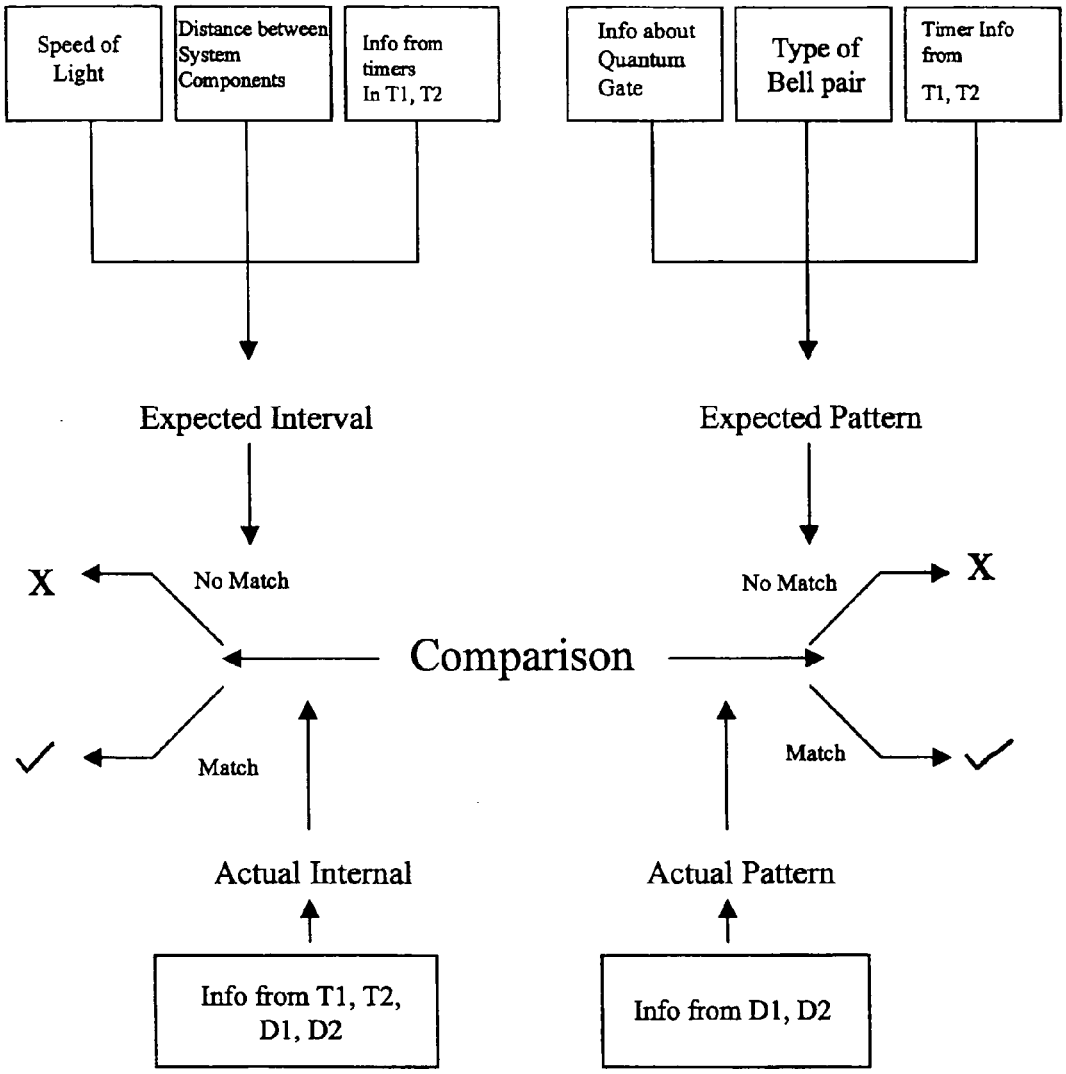
FIG. 5 is a flow diagram that illustrates the authentication method employed by the system of FIG. 1.

Referring to FIG. 5, as a first step, the central management module determines the "expected detection interval" for each Bell pair. The "expected detection interval" is the time it takes the first and second photons (i.e. light) to travel from the shutter assemblies of transmitters $T_1$ and $T_2$ respectively, via X, to detector $D_1$ or $D_2$. It will be appreciated that the "expected detection interval" in the system shown in FIG. 1 is constant for all transmitted Bell pairs (unless the components of the system are moved).

Once the "expected detection interval" for a Bell pair has been calculated, the central management module determines where detection should occur, i.e. the "expected detection pattern". As explained above, a randomiser within the central management module determines whether a given Bell pair is transmitted in Bell state $\Psi^-$ or Bell state $\Psi^+$. Since the quantum gate Q always differentiates between $\Psi^+$ and $\Psi^-$ in the same manner, the central management module is able to predict where detection should occur for each Bell pair: if the first and second photons of a Bell pair are in the Bell state $\Psi^-$, detection should occur at both $D_1$ and $D_2$, whereas for the Bell state $\Psi^+$, detection should occur at either $D_1$ or $D_2$.

Once a given Bell pair has been transmitted and detected, its expected (or theoretical) detection interval and detection pattern values are compared to the corresponding actual (or real) values. The actual detection intervals are derived from the timer information the transmitters' shutter assemblies and the detectors send to the central management module, while the actual detection pattern is evident from the information the module receives from the detectors per se.

The outcome of the comparison between the expected and the actual values determines whether or not the system certifies secure tagging. If the expected detection intervals and patterns for a given Bell pair match the actual detection intervals and patterns, the system can guarantee that X (or another object having the same type of quantum gate), was in its expected position at the time the Bell pair was transmitted. If, on the other hand, there is no coincidence of expected and actual values, the location of X is not guaranteed.

The management module is configured to alert users of the system in certain circumstances. Thus, for instance, it may raise an alarm when the actual detection intervals or patterns for three consecutively transmitted Bell pairs do not match their corresponding expected values. Alternatively, the module may be configured to raise an alarm when a certain percentage of transmissions fails over a certain period. Ideally, the user should be alerted whenever a transmitted Bell pair fails to arrive at the correct detector(s) at the correct time, but this may not be workable in practice since, occasionally, photons are likely to be lost in the system. How exactly the alert function of the central management module is configured depends, for example, on the level of security that is required, the frequency of Bell pair transmission and the quality of the equipment used to build the system.

It should be noted that while the first embodiment described above with reference to FIGS. 1 to 5 represents one simple embodiment of the invention, the invention is not limited thereto. To illustrate this, a number of possible variants of the first embodiment will now be described.

A first variant of the first embodiment differs only in that the actual detection pattern is created by a sequence of separate transmissions from X. Thus, instead of redirecting the arriving first and second photons from X to $D_1$ and/or $D_2$, the first variant initially merely measures which Bell state they are in, using, for example, a beam splitter as described above. Once the Bell states of the arriving photons are known, X initiates appropriate transmission sequences to $D_1$ and/or $D_2$. Any transmissions from X to the detector(s) is made at the speed of light to preserve the restrictions imposed by relativistic signalling constraints. Transmissions may be in the form of classical information or quantum information.

In a second, particularly advantageous embodiment of the invention, the transmitters $T_1$ and $T_2$ contain quantum storage facilities, which retain photons, as required, before transmission. The quantum storage facilities may be permanent, for example in the form of delay lines that extend the distance a photon needs to travel prior to transmission, or flexible. If the quantum storage facilities are of the flexible variety, their functioning, in particular the duration of storage, is controlled by the central management module.

The availability of quantum storage in the transmitters greatly increases the flexibility system: it allows for a change in the location of Bell pair source S, or even the location of the tagging device X relative to the transmitters and detectors. For example, if S is not equidistant from $T_1$ and $T_2$, the photons travelling to the closer one of the transmitters may be stored such that simultaneous transmission of first and second photons in each Bell pair can nevertheless occur. Furthermore, quantum storage in the transmitters offers option of staggered (i.e. non-simultaneous) transmission of the first and second photons, which is necessary if X is to be authenticated in a position that is not equidistant from $T_1$ and $T_2$.

No matter where X is to be authenticated, in order to maintain the security of the system, it is essential that transmission of the first and second photons of each Bell pair is co-ordinated such that they arrive at X simultaneously. If one of the photons arrives at X before the other, this not only means that quantum storage is required within X but also gives eavesdroppers a chance to overcome the time constraints otherwise imposed by relativistic signalling. In any event it should be noted that, even if the first and second photons of a Bell pair always arrive at X at the same time, authentication can only be guaranteed if X is positioned within the area encompassed by the imaginary lines $T_1$–$D_1$, $D_1$–$T_2$, $T_2$–$D_2$ and $D_2$–$T_1$.

It should be noted that the invention is of course not restricted to the embodiments described above. A variety of quantum particles, not just photons, can be used to implement the invention.

We claim:

1. A method of verifying the position of a tagging device, the method comprising:

(A) storing response information in a quantum state of a quantum entity, the quantum entity comprising an entangled pair;

(B) separating the entangled pair into first and second entangled particles;

(C) conveying the first and second entangled particles to first and second emitters respectively;

(D) emitting the first and second particles of the entangled pair respectively from the first and second emitters to the tagging device;

(E) recombining the first and second entangled particles in the tagging device to determine the response information;

(F) transmitting a signal from the tagging device to at least one of a plurality of detectors;

(G) detecting and recording the arrival time of the signal at the or each receiving detector, the or each receiving detector being selected on the basis of the determined response information; and (H) comparing the arrival time of the signal at the or each receiving detector with an expected arrival time of the signal for the or each expected receiving detector;

wherein matching the expected and actual signal arrival time for an expected detector verifies the position of the tagging device.

2. The method of claim 1, wherein the first and second particles cannot be copied when they are in separate locations.

3. The method of claim 2, wherein the first and second entangled particles form a Bell pair.

4. The method of claim 1, wherein the emitting step comprises emitting the first and second particles such that they arrive at the tagging device at the same time.

5. The method of claim 1, further comprising calculating at a central management system the expected signal arrival time for an expected receiving detector, comparing this time with the actual signal arrival time at a receiving detector, and checking whether detection occurred at the expected detector.

6. The method of claim 5, further comprising alerting a user when the expected signal arrival time for an expected detector does not match the actual signal arrival time.

7. The method of claim 1, wherein the transmitting step comprises transmitting a quantum signal.

8. The method of claim 7, further comprising redirecting the first and second entangled particles at the tagging device to form the signal sent to at least one receiving detector.

9. The method of claim 1, further comprising storing at least one of the entangled particles.

10. The method of claim 9, wherein at least one of the entangled particles is stored before it is emitted.

11. The method of claim 1, further comprising arranging the emitters and detectors such that the expected arrival time of the signal at an expected detector can only be consistently matched by actual values if the first and second particles are recombined at the location of the tagging device.

12. The method of claim 1, further comprising repeating steps (A) to (H).

13. The method of claim 12, wherein steps (A) to (H) are repeated several times per second.

* * * * *